US008252394B2

(12) United States Patent
Fish et al.

(10) Patent No.: US 8,252,394 B2
(45) Date of Patent: Aug. 28, 2012

(54) THERMAL TRANSFER DONOR ELEMENTS WITH WATER SOLUBLE BLUE DYES

(75) Inventors: Brian M. Fish, Wilmington, DE (US); Alex Sergey Ionkin, Kennett Square, PA (US)

(73) Assignee: E I du Pont de Nemours and Company, Wilmington, DE (US)

( * ) Notice: Subject to any disclaimer, the term of this patent is extended or adjusted under 35 U.S.C. 154(b) by 471 days.

(21) Appl. No.: 12/645,945

(22) Filed: Dec. 23, 2009

(65) Prior Publication Data

US 2011/0151152 A1 Jun. 23, 2011

(51) Int. Cl.
*B41M 5/385* (2006.01)
*B41M 5/46* (2006.01)

(52) U.S. Cl. ..... 428/32.52; 427/146; 428/32.81; 503/227

(58) Field of Classification Search ..... None
See application file for complete search history.

(56) References Cited

U.S. PATENT DOCUMENTS 5,071,502 A 12/1991 Hashimoto et al.
5,512,931 A 4/1996 Nakajima et al.
2009/0148788 A1 6/2009 Ionkin

*Primary Examiner* — Bruce H Hess

(57) ABSTRACT

Provided are compositions derived from a polycarboxylic acid, water soluble blue dyes and blue pigments in a fixed weight ratio. The compositions can be used to prepare thermal transfer donor elements that can be used to make blue pixels of a color filter element with improved surface characteristics and lightfastness.

15 Claims, 2 Drawing Sheets

THERMAL TRANSFER DONOR ELEMENTS WITH WATER SOLUBLE BLUE DYES

FIELD OF THE INVENTION

The present invention relates to thermal transfer donor elements containing blue pigments in a certain weight ratio with blue dyes, methods of making such elements, their use in display and other applications.

BACKGROUND

Thermal transfer processes that use radiation to transfer material from a donor element to a receiver are known. Thermal transfer imaging processes are used in applications such as color proofing, electronic circuit manufacture, the manufacture of monochrome and color filters, and lithography.

Color filters can be manufactured by thermally transferring a layer of colored material from a thermal transfer donor element onto a receiver. Typically, the transferred layer comprises a polymeric material and one or more dyes and/or pigments. The polymeric material can comprise a cross-linkable binder that can be cured to form a more chemically and physically stable layer, one that is less susceptible to damage.

There remains a need, however, to identify compositions that, when annealed, produce color filters with improved properties. Desirable improvements include lower surface roughness, lower lip heights, lower pixel heights, and higher lightfastness.

SUMMARY

Figure 1:
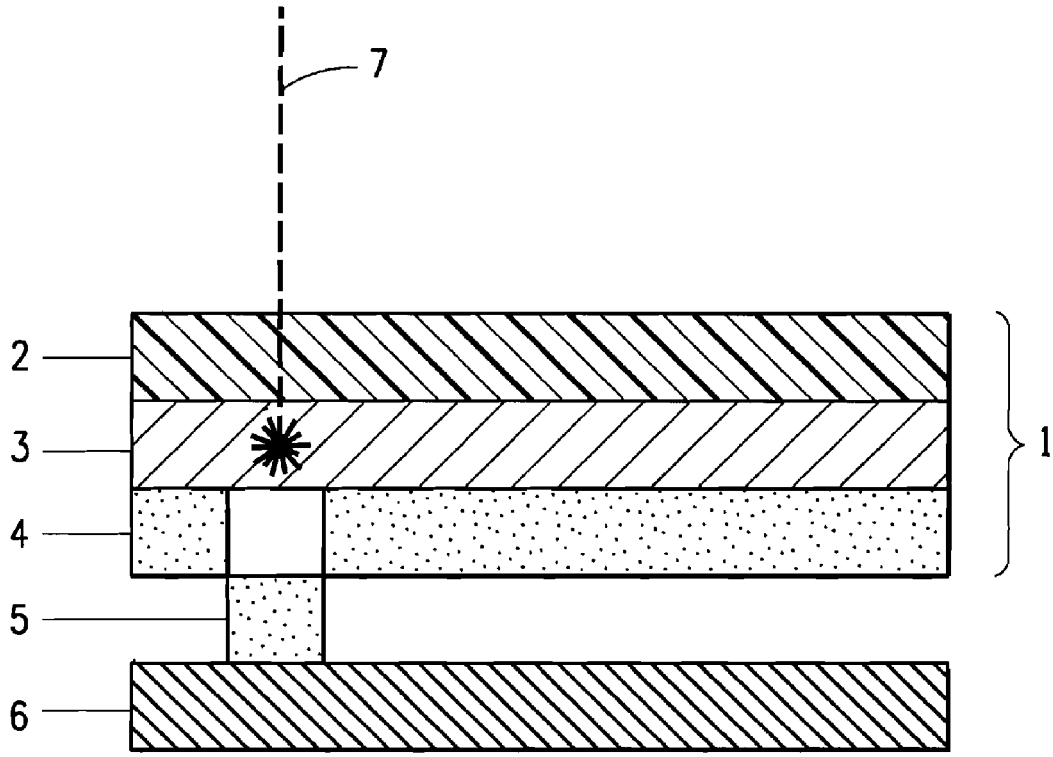
FIG. 1 is a schematic of an imageable assemblage and a thermal laser printing process.

One aspect of the present invention is a thermal transfer donor element comprising:

(a) a support;

(b) a thermal transfer layer disposed upon the support, wherein the thermal transfer layer is prepared from an aqueous thermal transfer composition comprising a polycarboxylic acid, a water soluble phthalocyanine blue dye, and a blue pigment, wherein the weight ratio of the blue pigment to the blue dye is from 0:1 to 10:1; and (c) an infrared-absorbing compound.

Another aspect of the present invention is a process comprising:

(a) coating a support with an aqueous thermal transfer composition comprising a polycarboxylic acid, a water soluble phthalocyanine blue dye, and a blue pigment to form a coated support, wherein the weight ratio of the blue pigment to the blue dye is from 0:1 to 10:1; and (b) heating the coated support.

A further aspect of the present invention is an imageable assemblage comprising:

(a) a donor element comprising a transparent donor support and a thermal transfer layer disposed on the support, wherein the thermal transfer layer is prepared by heating to 40° C. to 60° C. on a support an aqueous thermal transfer composition comprising a polycarboxylic acid, a phthalocyanine blue dye, and a blue pigment, wherein the weight ratio of the blue pigment to the blue dye is from 0:1 to 10:1; and (b) a receiver in contact with the thermal transfer layer of the donor element.

DETAILED DESCRIPTION

The present invention provides elements and processes for transferring a layer of colored material from a thermal transfer donor element onto a receiver.

In some embodiments, a laser source of infrared radiation is used in the transfer process, and the infrared absorbing compound is a laser dye. Infrared-absorbing laser dyes are commercially available and are known in the art.

The thermal transfer donor elements can be used, for example, to prepare color filters, which in turn can be used to prepare color filter films. The color filter films can be used, for example, in liquid crystal display devices, in which color filters that exhibit low surface roughness, low lip heights, low pixel heights, and high lightfastness are desirable.

Also provided are processes for forming thermal transfer donor elements for use in thermal transfer processes, imageable assemblages of a thermal transfer donor element and a receiver, and processes for transferring at least a portion of a thermal transfer layer from a thermal transfer donor element onto a receiver.

In one embodiment, the thermal transfer donor element comprises a support, a thermal transfer layer supported by the support, and a laser dye. The thermal transfer donor element can further comprise a heating layer disposed between the support and the thermal transfer layer.

Suitable supports for use in the thermal transfer donor element include materials that are dimensionally stable and are not degraded or deformed by the heat of a thermal printing process. "Dimensionally stable" means that the support material does not detectably melt, decompose or otherwise deform at the temperatures used in the processes disclosed herein. Suitable support materials include polyester films, polyolefin films, polyamide films, paper, glass, and fluoro-olefin films. In some embodiments, the support is transparent to infrared or near-infrared radiation. The support is typically 200 microns to 3000 microns thick, although thicker supports can also be used. Preferably, the support is from 1000 microns to 2000 microns thick. In some embodiments, the support is flat and has a uniform thickness, according to generally accepted industry standards.

The thermal transfer layer of the thermal transfer donor element, which is deposited onto the support, is prepared from an aqueous thermal transfer composition comprising a polycarboxylic acid, a water soluble phthalocyanine blue dye, and a blue pigment, wherein the weight ratio of the blue pigment to the blue dye is from 0:1 to 10:1. In some embodiments, the weight ratio of the blue pigment to the blue dye is from 2:1 to 8:1. In another embodiment, the weight ratio of the blue pigment to the blue dye is from 3:1 to 7:1.

The term "polycarboxylic acid" refers to an organic acid containing two or more carboxyl (COOH) groups. Herein, the polycarboxylic acid is a copolymer comprising repeat units derived from styrene and from one or more carboxylic comonomers, wherein the carboxylic comonomers are selected from the group consisting of acrylic acids, methacrylic acids, and combinations thereof. In some embodiments, the polycarboxylic acid copolymer used in the thermal transfer layer has a molecular weight of 2,000 to 50,000 g/mole. Preferably, the molecular weight is 3,000 to 6,000 g/mole.

As is known in the art, polymers are generally formed by the polymerization of one or more monomers. For example, ethylene ($CH_2{=}CH_2$) can be polymerized to form poly(ethylene), in which the repeat unit is —($CH_2CH_2$)—. This repeat unit is said to be "derived from" ethylene. If only one type of monomer is used in the polymerization reaction, the polymer is often referred to as a "homopolymer." If more than one type of monomer is used in the polymerization reaction, for example, in the polymerization of ethylene with propylene, the resulting polymer is typically referred to as a "copolymer," comprising repeat units of —($CH_2CH_2$)— and —($CH_2CH(CH_3)$)— which are "derived from" ethylene and propylene, respectively.

In some embodiments, the aqueous thermal transfer composition further comprises a polyhydroxy compound. Suitable polyhydroxy compounds include 7,7,11,11-tetrakis[2-(2-hydroxyethoxy)ethoxy]-3,6,9,12,15-pentaoxaheptadecane-1,17-diol, and N1,N1,N7,N7-tetrakis(2-hydroxyethyl)heptanediamide. The polycarboxylic acid and polyhydroxy compound can react to form a cross-linked polymer. The polyhydroxy compound is also referred to herein as the polyol compound.

Suitable blue dyes for use in the thermal transfer layer include copper phthalocyanine tetrasulfonic acid salts. These salts include copper phthalocyanine-3,4',4",4'"-tetrasulfonic acid tetrahexylammonium salt, copper phthalocyanine-3,4',4",4'"-tetrasulfonic acid tetrasodium salt, and copper phthalocyanine-3,4',4",4'"-tetrasulfonic acid tetraethylammonium salt.

Suitable blue pigments for the thermal transfer layer include alpha-copper phthalocyanine and diindolo[2,3-c:2',3'-n]triphenodioxazine, 9,19-dichloro-5,15-diethyl-5,15-dihydro-, pigment blue 15:6.

The thermal transfer donor element also contains an infrared absorbing compound, such as a laser dye. Typically, the infrared absorbing compound, e.g., laser dye, is present in the thermal transfer layer. Alternatively, the infrared absorbing compound can be present in a heating layer disposed between the support and the thermal transfer layer. Suitable laser dyes include, for example, 1H-benz[e]indolium, 2-[2-[2-chloro-3-[[1,3-dihydro-1,1-dimethyl-3-(4-sulfobutyl)-2H-benz[e]indol-2-ylidene]ethylidene]-1-cyclohexen-1-yl]ethenyl]-1,1-dimethyl-3-(4-sulfobutyl)-, inner salt and related structures.

In some embodiments, the thermal transfer layer further comprises a surfactant and/or a defoaming agent. Suitable surfactants include salts of 3-[2-(perfluoroalkyl)ethylthio]propionate, for example, lithium 3-[2-(perfluoroalkyl)ethylthio]propionate. Suitable defoaming agents include acetylenic glycol non-ionic surfactants.

In some embodiments, the thermal transfer donor element comprises a heating layer, wherein the heating layer comprises an infrared absorbing compound. The infrared absorbing compound is selected from the group consisting of organic and inorganic materials that absorb infrared radiation, e.g., at 830 nm.

Suitable inorganic materials for use in the heating layer include carbon black, transition metal elements (scandium, yttrium, titanium, zirconium, hafnium, vanadium, niobium, tantalum, chromium, molybdenum, tungsten, manganese, iron, ruthenium, osmium, cobalt, rhodium, iridium, nickel, palladium, platinum, copper, silver, and gold), metallic elements (aluminum, gallium, indium, tin, lead, antimony, and alloys thereof), metal oxides, and alloys of aluminum, gallium, tin, or lead with the alkaline metals or alkaline earth metals (sodium, lithium, calcium, magnesium, and strontium).

Suitable organic materials for use in the heating layer are organic compounds that absorb laser light at infrared or near-infrared wavelengths. Such compounds can be selected from the group consisting of infrared or near-infrared absorbing dyes. Suitable near-infrared absorbing dyes include poly (substituted) phthalocyanine compounds; metal-containing phthalocyanine compounds; cyanine dyes; squarylium dyes; croconium dyes; oxyindolizine dyes; bis(chalcogenopyrylo) polymethine dyes; metal thiolate dyes; bis(aminoaryl)polymethine dyes; merocyanine dyes; quinoid dyes and combinations thereof.

Another embodiment is a process for preparing a thermal transfer donor element comprising:

(a) coating a support with an aqueous thermal transfer composition comprising a polycarboxylic acid, a water soluble phthalocyanine blue dye, and a blue pigment, wherein the weight ratio of the blue pigment to the blue dye is from 0:1 to 10:1; and an infrared absorbing compound, to form a coated support; and (b) heating the coated support.

"Based on dry weight measurements" means the total combined weight of the composition excluding the weight of any water. In some embodiments, the composition used to coat the support is prepared as an aqueous thermal transfer composition comprising 49 to 69 wt % or 55 to 65 wt % or 57 to 60 wt % polycarboxylic acid, 15 to 39 wt % or 20 to 35 wt % or 25 to 30 wt % blue dye and 0 to 25 wt % or 5 to 20 wt % or 10 to 15 wt % blue pigment, based on dry weight measurements. The composition can further comprise colorants selected from the group consisting of organic pigments, inorganic pigments, dyes, and combinations thereof; surfactants; defoaming agents; and other additives.

The aqueous formulation is typically prepared by a two-step process. In the first step, a dye premix is prepared by mixing the dye and a fluorosurfactant in water. Methanol can be added to this premix in order to enhance solubility. In the second step, polycarboxylic acid is added to the dye premix, followed by the addition of the blue pigment and the infrared absorbing compound, e.g., laser dye, followed by other optional components, such as other colorants, surfactants and de-foaming agents, and further mixing. The aqueous formulation is then coated onto the support by any of several conventional coating techniques, including but not limited to spin-coating, doctor blade coating, spraying, dip-coating, or draw-down coating.

In some embodiments, the coated support is heated at 40° C. to 60° C. or most preferably at 45° C. to 50° C. to obtain a dry film of the thermal transfer layer on the support. In some embodiments, the thermal transfer layer can be further heated at 200° C. to 300° C. to produce an annealed film on the support.

Alternatively, the thermal transfer layer can be transferred to a receiver by, for example, a thermal laser printing process before annealing. FIG. 1 depicts one embodiment of a thermal transfer donor element (1) comprising a support (2), an optional heating layer (3), and a thermal transfer layer (4). FIG. 1 also depicts a thermal laser printing process, in which laser radiation (7) is directed to the heating layer, causing a portion (5) of the thermal transfer layer to be released from the donor element and transferred to the receiver (6).

One embodiment is an imageable assemblage comprising:

(a) a donor element comprising a transparent donor support and a thermal transfer layer disposed on the support, wherein the thermal transfer layer is made by heating at 40° C. to 60° C. on a support an aqueous thermal transfer composition comprising a polycarboxylic acid, a water soluble phthalocyanine blue dye, and a blue pigment, wherein the weight ratio of the blue pigment to the blue dye is from 0:1 to 10:1; and (b) a receiver in contact with the thermal transfer layer of the donor element. The donor element can further comprise a heating layer disposed between the transparent donor support and the thermal transfer heating layer. Heating the aqueous thermal transfer composition on the support at 40° C. to 60° C. for about 5 minutes typically removes enough of the water from the aqueous composition to form a film.

Suitable receivers include polyester films, polyolefin films, polyamide films, paper, sheets of glass, and fluoro-olefin films.

Another embodiment is a process comprising directing laser radiation to a surface of a transparent donor support of a donor element of an imageable assemblage; heating a portion of the thermal transfer layer to cause it to transfer to the receiver; and separating the receiver from the donor element. This process can be used to make a so-called "color filter element" for use in a liquid crystal display. A color filter element typically includes many three-color pixels, each pixel having three windows, and each window having a different color filter (usually red, blue and green), also referred to as the red color filter, blue color filter and green color filter respectively. The color filters partially transmit visible light, so that white light is filtered to become red, blue, and green light after passing through the three filters. The borders of the color filters can be defined by a rubber black matrix A Tencor P-15 Stylus profilometer can be used to measure surface characteristics of a color filter (or color filter pixel) that has been formed by transferring a portion of thermal transfer layer to the receiver. Typical measurements include the surface roughness (Wa), where Wa is a measure of surface roughness, and is roughly correlated with the distance between the top of the bumps and the bottom of the valleys. Typical measurements also include lip height of the pixel, and pixel height (or step height) of a particular pixel, where the pixel height (or step height) average is the averaged height of the transferred material. Lip height refers to the height of a raised feature or edge of the pattern (the "lip") that comprises transfer layer on the receiver element near the margins of the pattern imaged, expressed as the height above the average height of the pattern that comprises transfer layer.

Figure 2:
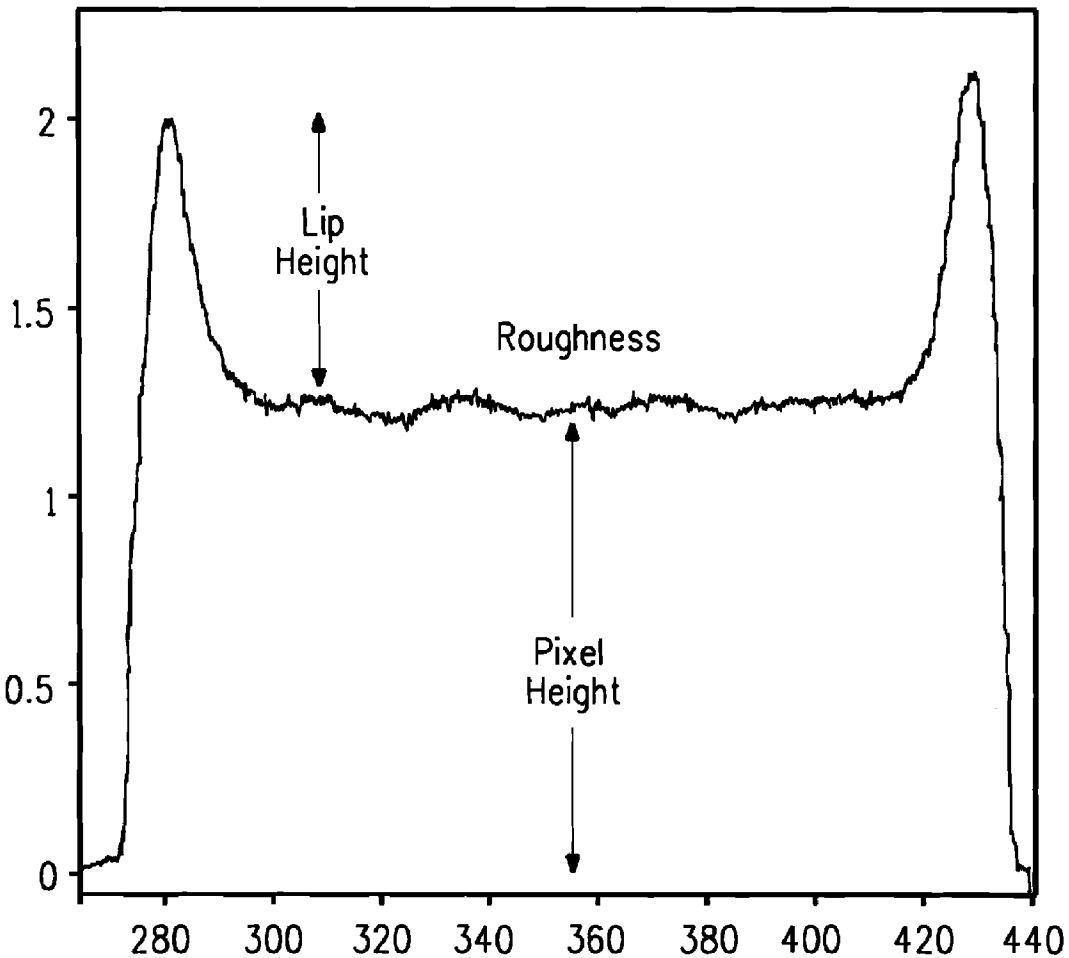
FIG. 2 is a representation of the parameters that are measured on a pixel using a profilometer.

FIG. 2 shows the height profile and surface characteristics of a color filter using the profilometer.

Ideally, each color pixel should be of uniform thickness and free of lips and other surface irregularities. A low lip height (e.g., less than about 0.35, 0.30, 0.20, 0.10, or 0.05 microns) and low roughness (e.g., having a high frequency roughness less than about 4.0 nm and/or a low frequency roughness of less than about 11.0 nm) help reduce distortions in the light passed through the color filter. In the examples below, the average height of a pixel is defined as the average of the elevation above the rubber black matrix.

EXAMPLES

The present invention is further illustrated in the following Examples. These examples are given by way of illustration only. From the above discussion and these examples, one skilled in the art can ascertain the essential characteristics of this invention, and without departing from the spirit and scope thereof, can make various changes and modifications to adapt it to various uses and conditions.

General Information:

Unless otherwise specified below, all chemical reagents were obtained from the Sigma-Aldrich Chemical Co. (St. Louis, Mo.). Pigments were obtained from Penn Color (Doylestown, Pa.).

Copper phthalocyanine-3,4',", 4'"-tetrasulfonic acid tetrasodium salt was obtained from Sigma-Aldrich.

Carboset® GA 2300 is a carboxylic-acid-containing binder acrylic copolymer (available from Noveon, Inc., Cleveland, Ohio) having a carboxylic acid concentration of approximately 3.6 mM (millimoles) carboxylic acid per gram binder, a Mw of approximately 11,000 grams per mole, and a glass transition temperature of about 70° C., and is available in a volatile carrier.

SDA-4927 is 2-[2-[2-chloro-3[2-(1,3-dihydro-1,1-dimethyl-3-(4-dimethyl-3(4-sulfobutyl)-2H-benz[e]indol-2-ylidene)ethylidene]-1-cyclohexen-1-yl]ethenyl]-1,1-dimethyl-3-(sulfobutyl)-1H-benz[e]indolium, inner salt, free acid [CAS No. 162411-28-1]. SDA-4927 (H.W. Sands Corp., Jupiter, Fla.) is an infrared dye that absorbs light of wavelength about 830 nm.

Polyol DPP®130, also known as poly(oxy-1,2-ethanediyl), -hydro-T-hydroxy-, ether with 2,2'-(oxybis(methylene)) bis(2-hydroxymethyl)-1,3-propanediol) (6:1) (CAS No. 50977-32-7), is an ethoxylated dipentaerythritol polymer clear liquid, available from Perstorp Polyols Inc, Toledo, Ohio, that comprises a $(—CH_2)_3CCH_2OCH_2C(CH_2—)_3$ chemical structure.

The fluorosurfactant contains a salt of 3-[2-(perfluoroalkyl)ethylthio]propionate, and is available from E.I. du Pont de Nemours and Company, Wilmington Del.

32S412D is Blue 32S412D pigment dispersion, 40% in water (Penn Color, Doylestown, Pa.).

32S349D is Blue 32S349D pigment dispersion, 40% in water (Penn Color, Doylestown, Pa.).

Surfynol DF110D (Air Products and Chemicals, Allentown, Pa.) is a nonionic, nonsilicone, acetylenic-based, defoamer (2,5,8,14-tetramethyl-6-dodecyne-5,8-diol, CAS [68227-33-8]), at 32% active solids in dipropylene glycol.

A Tencor P-15 Stylus profilometer (KLA-Tencor, San Jose, Calif.) was used to measure the height (in microns) of transferred material.

Example 1

Synthesis of the Dyes

(a) Synthesis of copper phthalocyanine-3,4',4",4'"-tetrasulfonic acid tetrahexylammonium salt Copper phthalocyanine-3,4',4",4'"-tetrasulfonic acid tetrasodium salt (hereinafter referred to as Dye-Na) (5 g) and tetrahexylammonium bromide (9.71 g) were dissolved in 500 mL of deionized water. The solution was heated at 60° C. for 2-4 days. The reaction was quenched by pouring the reaction mixture into ice and the product was extracted twice with 200 mL of dichloromethane. The organic layers were dried using anhydrous magnesium sulfate and the solvent was removed in a Büchi Rotatory evaporator. Copper phthalocyanine-3,4',4",4'"-tetrasulfonic acid tetrahexylammonium salt (10.2 g, 2311 g/mol, 86.2% yield), hereinafter referred to as Dye-THA, was obtained. The identity of the product was analyzed by mass-spectral analysis (Orbitrap MS, ESMS, -ve ion).

(b) Synthesis of copper phthalocyanine-3,4',4",4'"-tetrasulfonic acid tetraethylammonium salt The synthesis is similar to the synthesis of Dye-THA except for the use of 3.54 g of tetraethylammonium bromide instead of 9.71 g of tetrahexyl ammonium bromide. The product, copper phthalocyanine-3,4',4",4'"-tetrasulfonic acid tetraethylammonium salt (10.2 g, 2311 g/mol, 86.2% yield), hereinafter referred to as Dye-TEA, was obtained.

Example 2

(a) Preparation of Dye Premixes

For Dye-Na and Dye-THA, aqueous dye premix solutions containing 8 wt % of the fluorosurfactant and 36 wt % of the respective dye were prepared. In the case of Dye-TEA, an aqueous dye premix solution containing 8 wt % of the fluorosurfactant and 14 wt % of the respective dye was prepared. The constituents of the three dye premixes are given in Table 1. The dye was placed in a pre-weighed glass vial, followed by the addition of the fluorosurfactant. Water was slowly added to the vial until the weight of the solution was 20 g. In case of Dye-TEA, 2 mL of methanol were added after the water addition step to improve the solubility of Dye-TEA.

TABLE 1

Composition of the dye premix solutions

| Dye | Amount of Dye (g) | Amount of the fluorosurfactant (g) | Total weight (g) | Methanol (in ml) |
|---|---|---|---|---|
| Dye-Na | 7.2 | 1.6 | 20 | — |
| Dye-TEA | 2.8 | 1.6 | 22 | 2 |
| Dye-THA | 7.2 | 1.6 | 20 | — |

(b) Typical Preparation of Formulations

De-ionized water and Carboset® GA 2300 solution (density=1.066 g/L, 28.5 wt %) were added to a vial, followed by addition of the premix dye solution and 32S349D blue pigment. The mixture was shaken for 5 minutes before the subsequent addition of SDA 4927 IR dye, the fluorosurfactant and Surfynol® DF 110D. The mixture was then shaken for 2 to 12 h. The amount of water, 32S349D blue pigment, Carboset® GA 2300 solution, premix dye solution, the fluorosurfactant and the polyhydroxy compound (Polyol DPP 130) used in each formulation are given in Table 2. In addition each formulation contains 0.030 g of Surfynol® DF 110D, 0.246 g of polyhydroxy compound (Polyol DPP 130), and 0.032 g of SDA 4927 IR dye (not shown in Table 2).

TABLE 2

Composition of Formulations

| Sample | Dye | Water (g) | Carboset ® GA 2300 (g) | Premix dye solution (g) | 32S349D Blue pigment (g) | Fluorosurfactant (g) | % wt of dye |
|---|---|---|---|---|---|---|---|
| 1 | Dye-Na | 5.826 | 5.715 | 0.833 | 2.101 | 0.180 | 10 |
| 2 | Dye-Na | 5.875 | 5.715 | 1.250 | 1.671 | 0.180 | 15 |
| 3 | Dye-Na | 5.889 | 5.716 | 1.667 | 1.241 | 0.180 | 20 |
| 4 | Dye-Na | 5.901 | 5.716 | 2.083 | 0.812 | 0.180 | 25 |
| 5 | Dye-THA | 5.804 | 5.716 | 0.833 | 2.160 | 0.180 | 10 |
| 6 | Dye-THA | 5.829 | 5.716 | 1.250 | 1.718 | 0.180 | 15 |
| 6-a | Dye-THA | 5.804 | 7.358 | 1.250 | 0 | 0.060 | 15 |
| 7 | Dye-THA | 5.853 | 5.716 | 1.667 | 1.277 | 0.180 | 20 |
| 8 | Dye-THA | 5.879 | 5.716 | 2.083 | 0.835 | 0.180 | 25 |
| 9 | Dye-TEA | 4.494 | 5.716 | 2.143 | 2.160 | 0.180 | 10 |
| 10 | Dye-TEA | 3.864 | 5.716 | 3.214 | 1.718 | 0.180 | 15 |
| 11 | Dye-TEA | 3.235 | 5.716 | 4.286 | 1.277 | 0.180 | 20 |

Based on Tables 1 and 2, the weight ratio of the pigment to the dye was calculated as shown in Table 3.

TABLE 3

Calculation of the weight ratio of blue pigment to blue dye

| Sample | Dye | Dye premix (g) | Dye in the dye premix (g) | Wt. of dye premix added to the aqueous formulation (g) | Effective wt of the dye in the formulation* (g) | Wt. of pigment 32S349D (g) | Pigment/Dye (wt/wt) |
|---|---|---|---|---|---|---|---|
| 1 | Dye-Na | 20 | 7.2 | 0.833 | 0.30 | 2.101 | 7.00 |
| 2 | Dye-Na | 20 | 7.2 | 1.25 | 0.45 | 1.671 | 3.71 |
| 3 | Dye-Na | 20 | 7.2 | 1.667 | 0.600 | 1.241 | 2.07 |
| 4 | Dye-Na | 20 | 7.2 | 2.083 | 0.75 | 0.812 | 1.08 |
| 5 | Dye-THA | 20 | 7.2 | 0.833 | 0.30 | 2.16 | 7.20 |
| 6 | Dye-THA | 20 | 7.2 | 1.25 | 0.45 | 1.718 | 3.82 |
| 6-a | Dye-THA | 20 | 7.2 | 1.25 | 0.45 | 0 | 0 |
| 7 | Dye-THA | 20 | 7.2 | 1.667 | 0.60 | 1.277 | 2.13 |
| 8 | Dye-THA | 20 | 7.2 | 2.083 | 0.75 | 0.835 | 1.11 |
| 9 | Dye-TEA | 22 | 2.8 | 2.143 | 0.27 | 2.16 | 7.92 |
| 10 | Dye-TEA | 22 | 2.8 | 3.214 | 0.41 | 1.718 | 4.20 |
| 11 | Dye-TEA | 22 | 2.8 | 4.286 | 0.54 | 1.277 | 2.34 |

Effective weight of the dye in the formulation was calculated as: (Amount of the dye in the premix/Total wt. of the dye premix)×(Wt. of the dye premix added to the formulation)

Preparation of Formulation for Comparative Example

De-ionized water (6.001 g) and Carboset® GA 2300 solution (5.416 g, density=1.066 g/L, 28.5 wt %) were added to a pre-weighed glass vial, followed by addition of the 1.578 g of 32S412D and 1.425 g of 32S349D blue pigment. The mixture was shaken for 5 minutes before the subsequent addition of 0.030 g SDA 4927 IR dye, 0.315 g of Polyol DPP130, 0.060 g of fluorosurfactant, 0.315 g of Surfynol® DF 110D, 0.100 g of ammonium hydroxide and 0.045 g Nacure® 3525. The mixture was then shaken for 2 to 12 h.

Example 3

General Procedure for Making Donor Elements and Imaging

After a pigmented formulation mixture of Example 2 had been shaken for several hours, the pigmented formulation (10 ml) was filtered through a 1 μm syringe filter onto a Mylar® sheet in front of a draw-down bar. The draw-down bar was used to deposit the formulation uniformly across the Mylar® sheet. The coated Mylar® sheet was then heated at 50° C. in a drying oven for 5 min to form a thermal transfer layer on the Mylar® sheet. Imaging was carried out by contacting the thermal transfer layer with a glass sheet receiver, and directing laser radiation through the transparent donor support (the Mylar® sheet) and onto the thermal transfer layer. The portion of the thermal transfer layer that had been exposed to the laser radiation was transferred to the glass and remained on the glass when the Mylar® sheet and the receiver were separated.

Example 4

General Procedure for Testing Surface Features

The glass and transferred layers obtained from Example 3 were then annealed at 230° C. for 1 h in air. The annealed panel was analyzed using a KLA-Tencor Profilometer to determine the pixel heights, lip heights and mean taper angle of each blue color filter obtained from the different samples as recorded in Table 5.

This data shows that one or more surface characteristics (lip height, high frequency roughness, low frequency roughness) are improved relative to the control sample for blue color filter samples in which the ratio of the blue dye to the blue pigment is from 0:1 to 10:1.

TABLE 5

Surface features and mean taper angle

| Sample | Wt % dye | Average lip-height (microns) | Pixel height (microns) | High Frequency Roughness (nm) | Low Frequency Roughness (nm) | Mean Taper angle (degrees) |
|---|---|---|---|---|---|---|
| Control | 0 | 0.381 | 0.883 | 4.15 | 11.80 | 9.936 |
| 1 | 10 | 0.388 | 0.786 | 3.19 | 7.94 | 9.717 |
| 2 | 15 | 0.304 | 0.631 | 3.88 | 6.53 | 7.128 |
| 3 | 20 | 0.300 | 0.507 | 8.26 | 10.23 | 6.811 |

TABLE 5-continued

Surface features and mean taper angle

| Sample | Wt % dye | Average lip-height (microns) | Pixel height (microns) | High Frequency Roughness (nm) | Low Frequency Roughness (nm) | Mean Taper angle (degrees) |
|---|---|---|---|---|---|---|
| 4 | 25 | 0.276 | 0.427 | N.D. | N.D. | 6.053 |
| 5 | 10 | 0.194 | 0.660 | 2.50 | 6.84 | 5.479 |
| 6 | 15 | 0.176 | 0.670 | N.D. | N.D. | 4.071 |
| 6-a | 15 | 0.123 | 0.883 | N.D. | N.D. | 3.463 |
| 7 | 20 | 0.029 | 0.812 | 2.63 | 3.83 | 2.816 |
| 8 | 25 | 0.119 | 0.497 | N.D. | N.D. | 3.044 |
| 9 | 10 | 0.317 | 0.753 | N.D. | N.D. | 6.239 |
| 10 | 15 | 0.360 | 0.923 | N.D. | N.D. | 7.608 |
| 11 | 20 | 0.291 | 0.789 | N.D. | N.D. | 6.195 |

N.D. = "not determined"

Example 5

General Procedure for Lightfastness Testing

This test was done by ultraviolet ozone (UVO) testing using a UVO Cleaner made by Jelight Co., Inc. (Irvine, Calif.). The samples that were to be tested were cut, using a diamond tipped glass cutter, from the annealed panel of Example 4, using the formulation of Sample 2. The dimensions of the cut panel were 3.6 cm×4 cm.

A panel using the formulation containing the comparative example was also made. The samples were washed with deionized water prior to UV exposure.

Color measurements were carried out at 10 minute intervals between exposures to UVO at room temperature. This process increased the temperature of the chamber from room temperature to 50° C. The results of the lightfastness test are presented in Table 6.

TABLE 6

Comparison of the Lightfastness of an Annealed Panel Prepared from a Control Formulation and a Formulation of Sample 2

| Time | ΔEuv | |
|---|---|---|
| (Min) | Control | Sample 2 |
| 10 | 0.351 | 0.527 |
| 20 | 0.515 | 0.590 |
| 30 | 0.808 | 1.085 |
| 40 | 1.185 | 1.312 |
| 50 | 1.948 | 1.606 |
| 60 | 2.305 | 1.988 |

This data shows improved lightfastness after long exposure times (50-60 min) for a blue color filter sample prepared containing 15 wt % Na-dye vs. a control sample containing no blue dye.

What is claimed is:

1. A thermal transfer donor element comprising:

(a) a support;

(b) a thermal transfer layer disposed upon the support, wherein the thermal transfer layer is made from an aqueous thermal transfer composition comprising a polycarboxylic acid, a water soluble phthalocyanine blue dye, and a blue pigment, wherein the weight ratio of the blue pigment to the blue dye is from 0:1 to 10:1; and (c) an infrared-absorbing compound.

2. The donor element of claim 1, wherein the polycarboxylic acid is a copolymer comprising repeat units derived from styrene and at least one carboxylic comonomer selected from the group consisting of acrylic acids, and methacrylic acids.

3. The donor element of claim 2, wherein the copolymer has a molecular weight of 2,000 to 50,000 g/mole.

4. The donor element of claim 1, wherein the phthalocyanine blue dye is a copper phthalocyanine sulfonic acid salt.

5. The donor element of claim 1, wherein the aqueous thermal transfer composition comprises 49 to 69 weight percent of the polycarboxylic acid, and 15 to 39 weight percent of the phthalocyanine blue dye, based on the total combined weight of the polycarboxylic acid, phthalocyanine blue dye and the infrared-absorbing compound.

6. The donor element of claim 1, wherein the composition further comprises a polyhydroxy compound.

7. The donor element of claim 1, wherein the aqueous thermal transfer composition further comprises at least one colorant selected from the group consisting of organic pigments and inorganic pigments.

8. The donor element of claim 1, wherein the aqueous thermal transfer composition further comprises a surfactant and a defoaming agent.

9. The donor element of claim 1, further comprising a heating layer disposed between the support and the thermal transfer layer.

10. The donor element of claim 1, wherein the infrared absorbing compound is present in the thermal transfer layer or is present in a heating layer disposed between the support and the thermal transfer layer.

11. The donor element of claim 1, wherein the support is selected from the group consisting of polyester films, polyolefin films, polyamide films, paper, glass sheets, and fluoroolefin films.

12. A process comprising:

(a) coating a support with an aqueous thermal transfer composition comprising a polycarboxylic acid, a water soluble phthalocyanine blue dye, and a blue pigment to form a coated support, wherein the weight ratio of the blue pigment to the blue dye is from 0:1 to 10:1; and (b) heating the coated support.

13. The process of claim 12, wherein the heating comprises (i) heating the coated support at 40° C. to 60° C. to obtain a dry film; and (ii) heating the dry film at 200° C. to 300° C. to form an annealed film.

14. An imageable assemblage comprising:

(a) a donor element comprising a transparent donor support and a thermal transfer layer disposed on the support, wherein the thermal transfer layer is made by heating to 40° C. to 60° C. on a support an aqueous thermal transfer composition comprising a polycarboxylic acid, a phthalocyanine blue dye, and a blue pigment, wherein the weight ratio of the blue pigment to the blue dye is from 0:1 to 10:1; and (b) a receiver in contact with the thermal transfer layer of the donor element.

15. The imageable assemblage of claim 14, wherein the donor element further comprises a heating layer disposed between the donor support and the thermal transfer heating layer.

* * * * *